US009327254B2

(12) United States Patent
Arnoni Junior

(10) Patent No.: US 9,327,254 B2
(45) Date of Patent: May 3, 2016

(54) MIXING PROCESS AND DEVICE FOR SAID MIXING PROCESS

(75) Inventor: Americo Arnoni Junior, São Paulo (BR)

(73) Assignee: O2W S.A., Marinha Grande (PT)

( * ) Notice: Subject to any disclaimer, the term of this patent is extended or adjusted under 35 U.S.C. 154(b) by 0 days.

(21) Appl. No.: 13/439,549

(22) Filed: Apr. 4, 2012

(65) Prior Publication Data

US 2012/0258215 A1 Oct. 11, 2012

(30) Foreign Application Priority Data

Apr. 6, 2011 (BR) ..... 1101472

(51) Int. Cl.

| | |
|---|---|
| ***B01F 7/18*** | (2006.01) |
| ***B01F 15/00*** | (2006.01) |
| ***C11C 5/02*** | (2006.01) |
| ***C11C 5/00*** | (2006.01) |

(52) U.S. Cl.

CPC ..... *B01F 7/18* (2013.01); *B01F 15/00175* (2013.01); *B01F 15/00253* (2013.01); *C11C 5/002* (2013.01); *C11C 5/02* (2013.01); *B01F 2015/00636* (2013.01)

(58) Field of Classification Search

CPC ..... B01F 7/18
USPC ..... 366/148
See application file for complete search history.

(56) References Cited

U.S. PATENT DOCUMENTS 7,910,758 B2 * 3/2011 Hassan et al. ..... 554/169
2008/0161588 A1 * 7/2008 Hassan et al. ..... 554/169

FOREIGN PATENT DOCUMENTS

WO WO2008130064 * 10/2008

OTHER PUBLICATIONS

Machine Translation of Wang, CN101831359, provided by esp@cenet. Retrieved Apr. 24, 2014.*

* cited by examiner

*Primary Examiner* — David Sorkin
*Assistant Examiner* — Abbas Rashid
(74) *Attorney, Agent, or Firm* — Leason Ellis LLP

(57) ABSTRACT

A mixing process is provided for the valorization of used cooking oils. The mixing process takes place in a particularly efficient way and includes supplying a given load (A) of used cooking oils and a corresponding load (B) of a solidifying composition to a mixing device. Thermal energy is supplied and in particular, an initial amount of thermal energy is supplied to cause the mixing temperature to reach a given temperature level. An additional amount of thermal energy is also supplied during a given mixing period. The solidifying composition includes a processing compound that includes at least two substances, one of which is of a wax type and the other is one of stearic acid, aromatic, coloring substances and additives.

16 Claims, 5 Drawing Sheets

MIXING PROCESS AND DEVICE FOR SAID MIXING PROCESS

CROSS REFERENCE TO RELATED APPLICATION

This application claims priority under 35 U.S.C. §119 to Brazilian patent application No. 1,101,472-5, filed Apr. 6, 2011, which is hereby incorporated by reference in its entirety.

BACKGROUND OF THE INVENTION

1. Field of the Invention

The present invention refers in general to the field of recycling of used cooking oils.

The present invention in particular refers to a process for valorization of previously collected and eventually filtered used cooking oils, by means of mixing a respective quantity of used cooking oils together with a corresponding quantity of a solidifying composition including a substance of the wax type or similar, so as to obtain a substantially homogeneous substance resulting from the mixture of both quantities. Moreover, the present invention refers to a mixing device for carrying out the process according to the invention.

2. Background of the Invention

The use of oils in cooking, particularly for frying, raises several environmental issues, in particular after their use and regarding their disposal. In this context, the possibility of valorization of used cooking oils at the point of use presents several advantages, because it avoids the logistic required for collecting used cooking oils to a central recycling or disposal location, and because it represents an additional source of economic value, allowing consumers to use a basic material for obtaining other materials or products for other uses and benefits.

However, processes for recycling used cooking oils in a domestic, or small scale commercial setting, whether this is that of a household or that of a restaurant, are conditioned by several technical and functional constraints. It is therefore particularly important that a process for recycling used cooking oils in such settings presents a set of characteristics, notably in terms of easy use (in particular, simple handling of raw materials involved) and in terms of general efficiency (in particular, obtaining the intended quality with the least energy use by the process). The present invention refers in particular to this last aspect.

In the scope of the present document, the expression "used cooking oils" refers to oils used in food in general, independently of their origin or production, for dressing or cooking, such as for example frying, or other uses, whereby oils are used or exceed their use deadline, and loose food grade value, being therefore available and suitable for recycling or final disposal. Within the meaning of the expression "used cooking oils" are further considered food oils in the liquid or solid state, as well as other substances of the fat type presenting characteristics similar to food oils.

Related Art

Processes for valorization of used cooking oils together with a solidifying composition are known in the state of the art.

In fact, the author has previously researched and developed the concept of recycling used cooking oils into candles, by means of their mixing together with a composition of solidifying substances, including waxes and similar substances. In particular the author has registered the PT 103856 thereby disclosing several functional aspects of a machine for producing candles based upon the processing of used cooking oils together with a solidifying composition provided in the form of a capsule. The PT 103856 does not disclose particular characteristics of the mixing process of a quantity of used cooking oils with the capsule of a processing composition, notably in terms of respective main steps, in view of maximizing respective energy efficiency while simultaneously ensuring a high quality level of the mixing process the aforementioned document also does not disclose particular aspects relating to the processing device included in the apparatus, notably in view of maximum energy efficiency associated to the mixing process.

The WO 2010/102370 A1 discloses an apparatus of domestic use for producing soap by means of recycling used cooking oils. This document points to the supply of the different compounds separately from the used cooking oil. Moreover, both the thermal and the mechanical energy to be provided during the mixing process are not generated by internal means of the apparatus in which the mixing device is integrated.

The aforementioned documents therefore do not disclose solutions in terms of the mixing process and of the device in which the mixing process takes place, in view of maximizing the energy efficiency and minimizing the time required for the process to be concluded, while simultaneously ensuring a high quality level of the mixing process, as well as particular safety conditions thereof.

In fact, using used cooking oils as raw material for the production of a new product with a new application, raises several technical issues, most of which relating to the highly contaminated and variable nature of "used cooking oils", as this may be available at a given household or small commercial establishment. In particular the production of candles, or other solid compositions, by means of mixing used cooking oils together with a solidifying composition, raises several particular issues as to the result of the inherent mixing process. In the case of manufacturing of candles, one specially considers the requirement of obtaining a product presenting structural stability at ambient temperature, of homogeneous structure and aspect, of regular and inasmuch as possible complete burning behavior, and, in particular, observing the applicable safety standards and regulations.

In this sense, the author has carried out several tests that have demonstrated that the global efficiency of mixing such a solidifying composition together with a quantity of used cooking oils, and the final quality of the product resulting from such a processing, largely depend upon the evolution and steps carried out in the mixing process.

The author has similarly researched different configurations of the mixing device, as well as possible dispositions for its main energy delivery means, thereby establishing a set of embodiments that are regarded as more advantageous for carrying out the mixing process.

SUMMARY DESCRIPTION OF THE INVENTION

The goal of the present invention is to provide a mixing process for processing a given quantity of used cooking oils, notably by means of an apparatus of the household appliance type, with the least energy consumption.

This goal is attained according to the invention by means of a mixing process with a first inventive characteristic as identified hereunder. Embodiments and preferred optimizations of the mixing process according to the invention result from the following characteristics.

Another goal of the present invention is to provide a mixing device for recycling of used cooking oils in a domestic setting, by means of processing a respective given quantity together with at least one solidifying composition, for example in the form of a processing pod. This goal is solved according to the invention by means of a mixing device according to a first inventive characteristic disclosed hereunder. Embodiments and preferred optimizations of the mixing device according to the invention result from the following characteristics.

The invention shall now be described in greater detail based upon preferred embodiments of the mixing process and device according to the invention, and upon respective figures that are attached hereto.

DETAILED DESCRIPTION OF PREFERRED EMBODIMENTS OF THE INVENTION

The present invention refers to a mixing process in conditions of maximum efficiency of a given quantity (hereinafter referred to as "load") of used cooking oils, in view of their valorization and later, different use. For this purpose, the load (A) of used cooking oils should be mixed as homogeneously as possible with a corresponding load (B) of a solidifying composition. In the case of the present invention, one in particular considers a mixing process carried out by an apparatus of comparatively small dimensions, appropriate for a household or small-scale commercial type of use.

The load (B) of a solidifying composition is provided in a given form as a processing consumable, configured for example as a pod, and corresponding to a certain quantity and/or composition of a given solidifying composition, preferentially conveniently pre-processed in respective units (B1), including at least two substances, one of which is of the wax type, or similar, preferentially of vegetal origin, and/or stearic acid, aromatic, coloring substances and additives.

The supply of the load (A) of used cooking oils is generally preceded by a step of mechanic and/or chemical filtering of the load (A), in particular in the case that these have been used for frying.

The supply of the load (A) of used cooking oils to a mixing device (1) preferentially takes place by means of the gravity force, through temporary release of an entry (2) for used cooking oils, during a previously defined period of time ($t_{adm}$) whose duration is function at least of the quantity of the load (B) of solidifying composition to be processed in a given operation cycle of the mixing device (1). For this purpose, the quantity of the load (B) of solidifying composition to be processed in a given operation cycle, should be previously notified by means of a respective user interface.

According to a preferred embodiment, the quantity of the load (A) of used cooking oils to be supplied to the mixing device (1) is, at least approximately, in the proportion of between 75 ml and 120 ml of used cooking oils, preferentially between 95 ml and 105 ml of used cooking oils, for each unit (B1) of processing consumable being supplied in each operation cycle.

Figure 1:
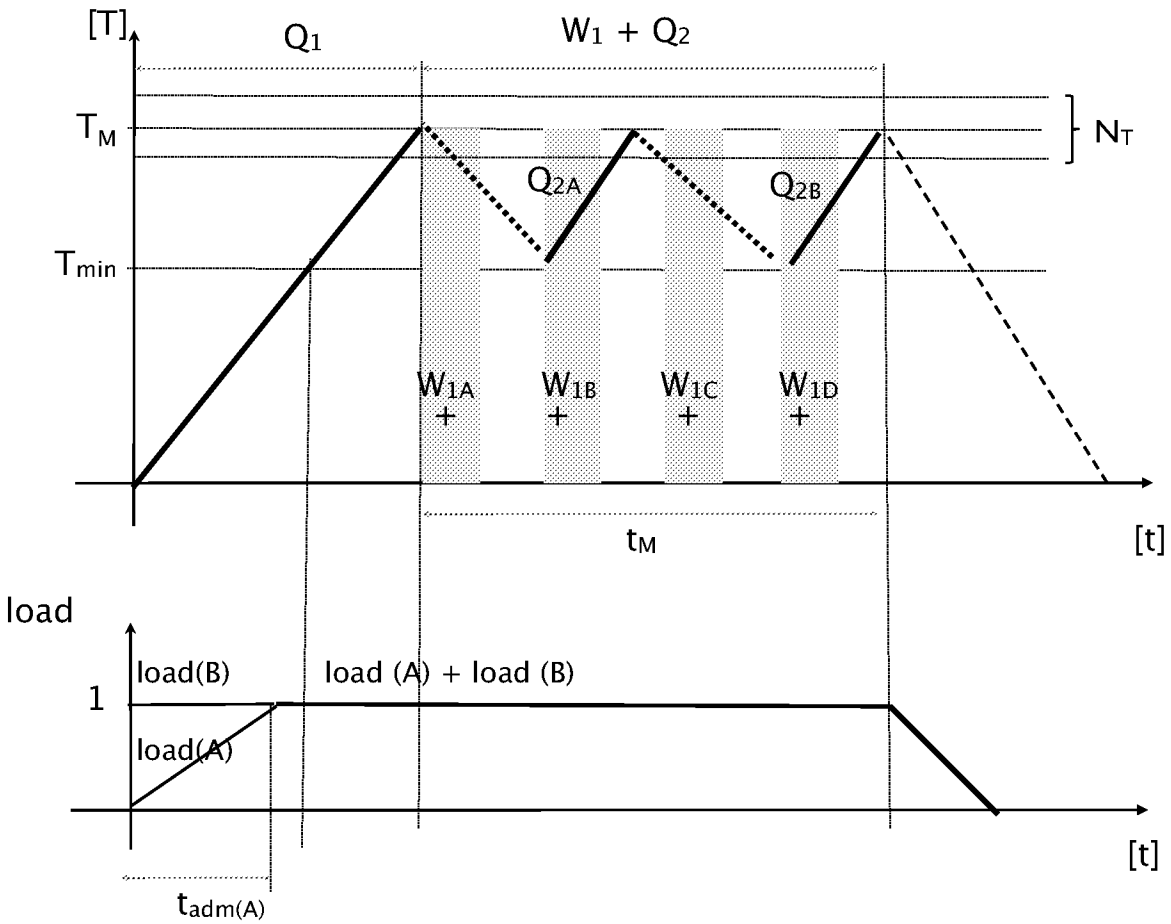
FIG. 1: schematic diagram representing the evolution in time of the steps included in a first embodiment of the mixing process according to the invention.
Figure 2A:
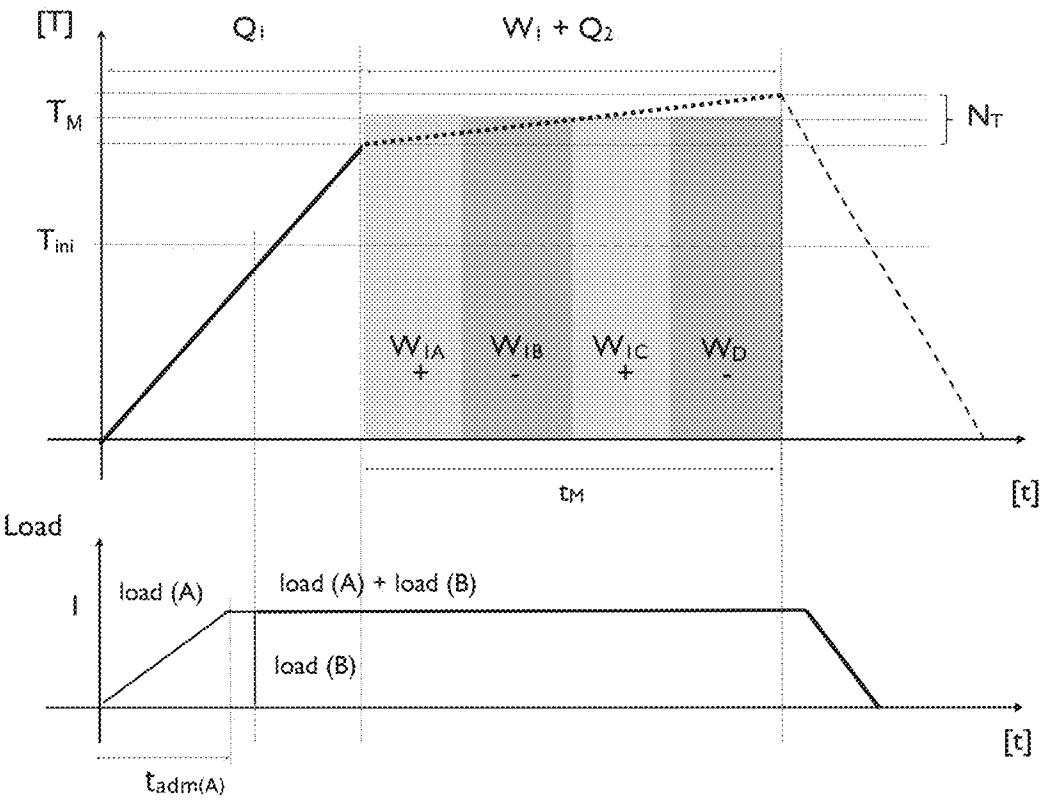
FIG. 2A: schematic diagram representing the evolution in time of the steps included in a second embodiment of the mixing process according to the invention.

FIGS. 1 and 2 show a schematic diagram representing the evolution of the main flows of energy in time, in a first and second preferred embodiments of a processing cycle of the mixing process according to the present invention.

The author has established that the supply sequence of the loads (A) and (B) to a mixing device (1), and in particular, the initial heating sequence may be or particular relevance to the overall efficiency process.

Regarding the supply sequence, the load (A) of used cooking oils and the load (B) of solidifying composition are supplied simultaneously, preferentially at least partially simultaneously, to the mixing device (1). Alternatively, according to a particularly preferred embodiment, the load (B) of solidifying composition is only supplied after the load (A) of used cooking oils has been delivered to the mixing device (1). This has been shown to be advantageous in some cases, especially when the load (A) is pre-heated before supplying the load (B), as further referred hereunder.

For motives of operation efficacy and of safety, according to a preferred embodiment, the beginning of supply of an initial thermal energy (Q1) only happens after verification of whether the load (A) corresponds to the minimum quantity that is in proportion for mixture with the previously defined load (B) of solidifying composition. This verification of the minimum quantity of the load (A) of used cooking oils inside the mixing device (1) is preferentially carried out by respective filling level detection means (4). The filling level detection means (4) may be mechanic, electro-mechanic or electronic, whereby they are preferentially executed in the form of electronic temperature sensors based on a temperature differential.

The supply of thermal energy is preferentially executed by heating means (6) provided in direct proximity of the mixing device (1). They are preferentially in the form of electric devices, such as for example electric resistances.

In the case of a first preferred embodiment (FIG. 1), the mixing process starts with the initial heating of both loads up to a previously defined temperature value, whereby the load (B) is supplied at an early moment and the load (A) is being supplied during a certain period of time, preferentially concluded before of the conclusion of the initial heating. Alternatively, the initial heating may start after both loads (A) and (B) are already present in their respective total quantities inside the mixing device (1).

Figure 2B:
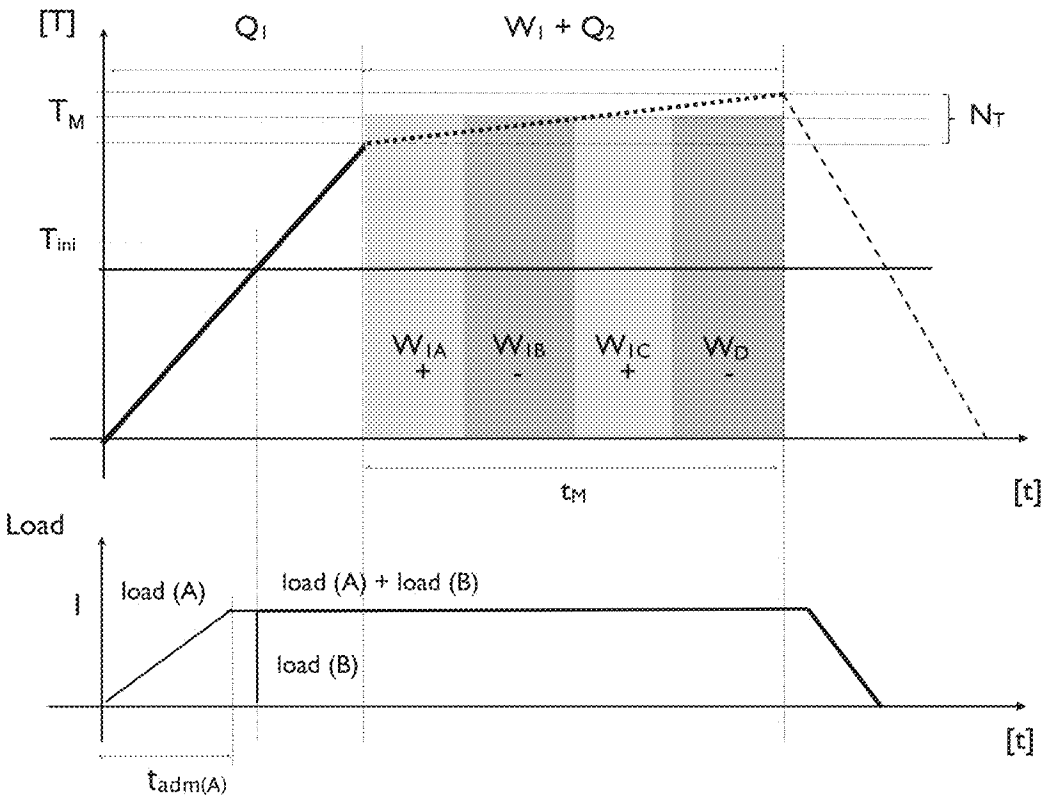
FIG. 2B: schematic diagram representing the evolution in time of the steps included in a third embodiment of the mixing process according to the invention.

In the case of a second preferred embodiment (FIG. 2A), the load (B) is only supplied after at least a part of the load (A) has already been supplied and preferentially heated up. Alternatively, the load (B) is supplied after heating up the totality of the load (A), at least up until a previously defined initial temperature value ($T_{ini}$) (FIG. 2B). This initial temperature value ($T_{ini}$) may be closer to a reference mixing temperature level ($N_T$), depending on the actual form of the units (B1). The author has established that this sequence is advantageous in terms some compositions and forms of the units (B1) of solidifying composition.

In fact, the initial heating of the loads (A) and (B) is preferentially carried out until reaching a reference temperature level ($N_T$) as referred to a previously defined mixing temperature value ($T_M$). In the case of the mixing process according to the invention, the mixing temperature value ($T_M$) in the range between 40 and 100° C., preferentially between 50 and 90° C., more preferentially between 60 and 80° C., whereby the reference temperature level ($N_T$) should be an interval corresponding to 8%, preferentially 5% above and below of the mixing temperature value ($T_M$). In this particular, the author has established through experimental analysis, that an initial heating phase up to this reference temperature level ($N_T$) leads to a certain degree of softening of the load (B) and to a substantially homogeneous heating of the load (A). Moreover, as resulting advantageous effect, the initial heating allows substantially reducing the humidity content eventually present in the load (A) of used cooking oils. This is an aspect that is particularly important in terms of final quality of the product to be obtained as a result of this process. Heating up beyond this reference temperature level ($N_T$) would only bring low marginal gains in terms of processing time and therefore not be efficient.

After having reached the temperature level ($N_T$) a second phase of the process takes place, lasting for a previously defined mixing period of time ($t_M$) and preferentially controlled by respective means integrated into the apparatus wherein the mixing device (1) operates. Characteristic of this phase is, according to the invention, the supply of a given amount of additional thermal energy (Q2) during the mixing period of time ($t_M$), the amount being characterized for not surpassing a given level of thermal capacity, or maintaining it at least during part of the mixing period, and this way at least approximately keeping the mixing temperature value ($T_M$), or not surpassing its corresponding reference level ($N_T$).

This second phase may be optimized by means of supplying mechanical energy to the mixing process. In fact, the author has established that the efficiency of the mixing process is in some cases increased by means of supplying mechanical energy (W1), preferentially after concluding the initial thermal energy supply (Q1), that is, after both loads (A) and (B) have been heated up to the reference temperature level ($N_T$). In any case, depending on the exact composition and compression degree of the unit (B1) of solidifying composition, the supply of mechanical energy (W1) may also start during the supply of initial thermal energy (Q1).

According to a preferred embodiment, the supply of mechanical energy (W1) is carried out by means of a rotation device (5) presenting a plurality of blades (5') attached to a rotation axis, disposed so that it may rotate around an axis, preferentially the symmetry axis, inside the mixing device (1).

As represented in FIG. 1, in a first embodiment of the mixing process according to the invention, the supply of mechanical energy (W1) is carried out so that the rotation device (5) executes a plurality of successive rotation cycles, for example in at least approximately equal periods of time, preferentially always in the same rotation direction.

In this particular, and according to a preferred embodiment, the rotation cycles start when the heating means (6) are turned off because a previously defined maximum temperature value has been reached, preferentially one value within the reference temperature level ($N_T$) or not greatly exceeding it. According to experiments carried out by the author, the maximum temperature value should preferentially not exceed 5% above the reference temperature level ($N_T$), that is not exceeding 105° C., preferentially not exceeding 95° C., more preferentially 85° C.

According to a second preferred embodiment of the mixing process (FIG. 2A), the supply of mechanical energy (W1) is carried out in a continuous way during the mixing period ($t_M$), in this case in alternated rotating directions. The same is true for the third embodiment of FIG. 2B.

Moreover, in the case of the mixing process according to the invention, the supply of additional thermal energy (Q2) is carried out during a, preferentially previously defined, period of time ($t_M$). In the case of the first embodiment (FIG. 1), the supply of additional thermal energy (Q2) is carried out in intervals spaced in time that begin when the mixing temperature (T) descends below a previously defined minimum temperature ($T_{min}$) and end the mixing temperature (T) ascends, driven by a respective additional thermal energy supply, up to the previously defined maximum temperature value, preferentially set within the reference temperature level ($N_T$). According to preferred embodiments, the minimum temperature value ($T_{min}$) is of at least 60%, preferentially of at least 70%, more preferentially of at least 80% of the mixing temperature value ($T_M$). In the case of the second embodiment (FIG. 2), the supply of additional thermal energy (Q2) is carried out continuously, preferentially at a substantially constant thermal capacity, so as to not surpass the reference temperature level ($N_T$) during the mixing period of time ($t_M$).

The discharge of the substantially liquid fusion (C) resulting after the mixing period of time ($t_M$), takes place by means of opening a respective exit (7) during a given period of time, and driven at least substantially by means of the gravity force.

According to a preferred embodiment, the control of the process is preferentially carried out by the user through two actuation elements, for example in the form of buttons, preferentially by means of only one actuation element, besides that of on-off of the mixing device (1). Moreover, the stage of execution of the process is communicated to the user by means of a light signal with at least one color, preferentially at least with at least with actuation frequency and, preferentially, at least one sound signal associated with its activation.

The present invention further refers to a mixing device (1) for carrying out a mixing process according to the invention, whereby the mixing device (1) includes means for the substantially airtight enclosure of both loads (A) and (B) relatively to the outside environment at least during the realization of the mixing process, preferentially at least during the supply of additional thermal energy (Q2).

Figure 3B:
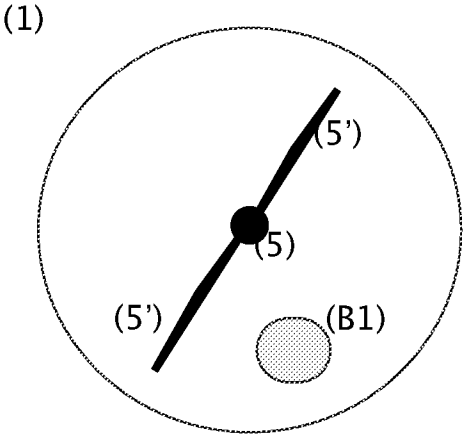
FIGS. 3*a*-3*b*: side and plan views of a first embodiment of a mixing device for carrying out the process according to the invention.
Figure 3A:
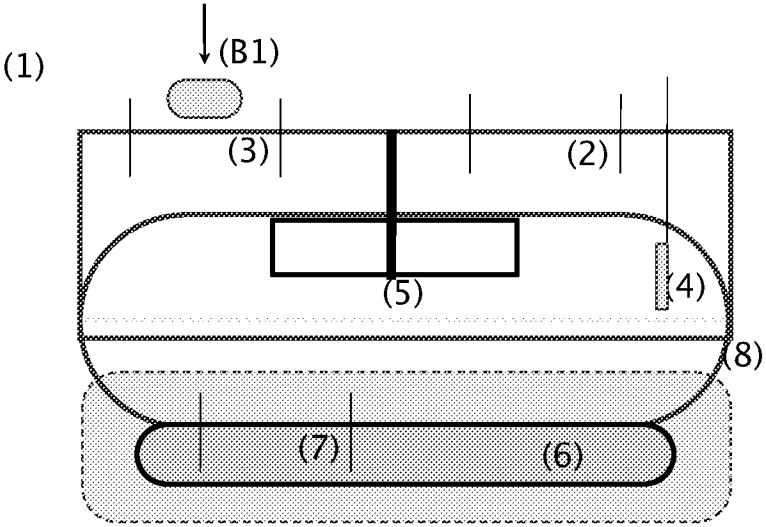

FIGS. 3*a* and 3*b* show a schematic representation in cut of a side elevation and a plan view from above, respectively, of a first preferred embodiment of the mixing device (1) according to the invention.

The mixing device (1) presents in this case a cylindrical shape of reduced height, with entries (2) and (3) for loads (A) and (B), respectively disposed on the top zone and an exit (7) for discharge of the fusion (C) disposed on the base zone (8).

The thermal energy means (6) are in this case executed in the form of an electric resistance disposed in the proximity of the base zone (8), and enveloped by a material of low thermal conductivity coefficient.

The mechanical energy means (5) are in this case executed in the form of a propeller with two blades (5'), disposed so that it may rotate around a symmetry axis of the mixing device (1). The inferior edges of the blades (5') are preferentially rounded.

Figure 4B:
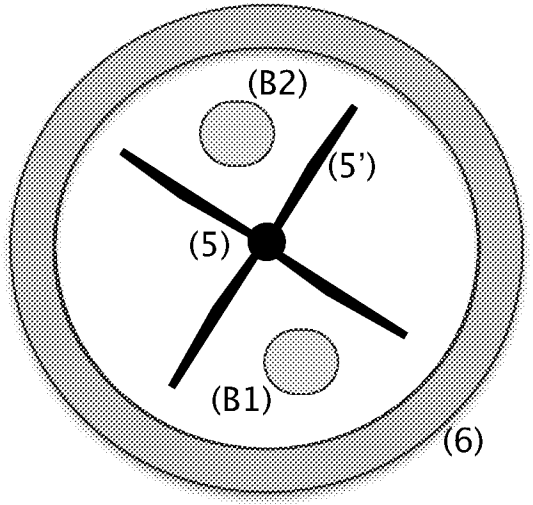
FIGS. 4*a*-4*b*: side and plan views of a second embodiment of a mixing device for carrying out the process according to the invention.
Figure 4A:
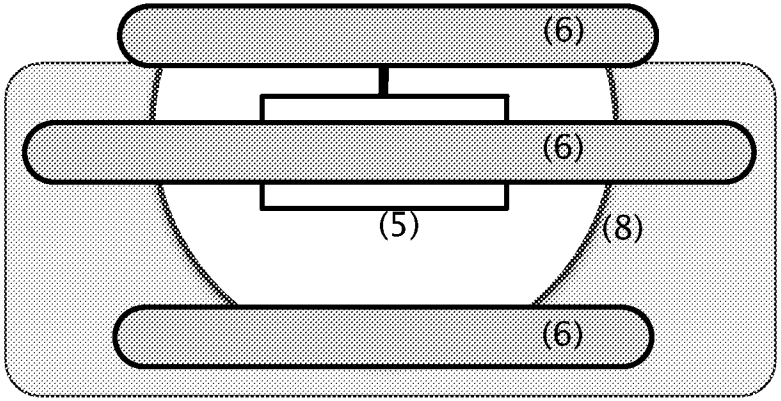

FIGS. 4*a* and 4*b* show a schematic representation in cut of a side elevation and a plan view from above, respectively, of a second preferred embodiment of the mixing device (1) according to the invention.

The mixing device (1) in this case presents the form of a spherical cap, also provided with two entries for loads (A) and (B) disposed on the top zone, and an exit (7) disposed on the base zone (8).

The thermal energy means (6) are in this case executed in the form of several electric resistances disposed on the vicinity of the base zone (8), approximately at half the height of the mixing device (1) and in the proximity of the top zone. In another embodiment of the present invention, the electric resistance means may be configured in the form of a serpentine or mesh, substantially covering the exterior surface of the mixing device (1) according to the invention. In this case as well, the electric resistance means are covered to the outside by a material of low thermal conductivity coefficient.

The mechanical energy means (5) are in this case executed in the form of a propeller with four blades (5'), disposed so that it may rotate around a symmetry axis of the mixing device (1).

According to one exemplary embodiment, the present invention is a mixing process of a load (A) including used cooking oils, or similar fats, with a load (B) of a processing composition, including the steps of:

- supplying a given load (A) and an at least approximately corresponding load (B) to a mixing device (1) so as to obtain a respective mixture;
- supplying an initial thermal energy (Q1) amount to the mixing device (1) until the mixing temperature (T) reaches a temperature level (NT) of a previously defined reference temperature value (TM);
- supplying an additional thermal energy (Q2) amount to the mixing device (1), preferentially at a previously defined constant power value, during a previously defined period of time (tM), at least so as for the mixing temperature (T) not to descend below a previously defined minimum temperature value ($T_{min}$);
- discharging of the fusion (C) out of the mixing device (1), after the previously defined period of time (tM).

According to one exemplary embodiment, the loads (A) and (B) are supplied simultaneously to the mixing device (1).

According to one exemplary embodiment, the load (B) is supplied to the mixing device (1) after at least a substantial part of the load (A) has reached a previously defined initial temperature value (Tini).

According to one exemplary embodiment, the mixing process includes a supply of mechanical energy (W1) to the mixing device (1) during at least part of the period of time (tM).

According to one exemplary embodiment, the supply of the load (A) of used cooking oils to the mixing device (1) is preceded by a step of mechanic and/or chemical filtering of the load (A) of used cooking oils.

According to one exemplary embodiment, the supply of the load (A) of used cooking oils to the mixing device (1) takes place, preferentially substantially driven by means of the gravity force, through the temporary opening of an admission for the load (A) of used cooking oils, during a previously defined period of time (tadm) and/or until a minimum filling level is detected, and whose duration is at least function of the quantity of the load (B) of processing composition.

According to one exemplary embodiment, the quantity of the load (B) to be processed in a respective mixing cycle is previously indicated by means of a use interface of the mixing device (1).

According to one exemplary embodiment, the quantity of the load (A) is preferentially automatically established based upon the indication of the quantity of the load (B) to be processed in a respective mixing cycle.

According to one exemplary embodiment, the load (B) is supplied in the form of at least one unit (B1), corresponding to a given quantity and/or constitution of the processing compound including at least two substances, one of which is of the wax type, or similar, preferentially of vegetal origin, and/or stearic acid, aromatic, coloring substances and additives.

According to one exemplary embodiment, the quantity of the load (A) to be supplied to the mixing device (1) is at least approximately in the proportion of the mixture of between 75 ml and 120 ml, preferentially between 95 ml and 105 ml of used cooking oils, for each unit (B1, . . . ) supplied, as load (B) of processing composition, in a respective mixing cycle.

According to one exemplary embodiment, the beginning of supply of the initial thermal energy (Q1) takes place after verification of whether the quantity of the load (A) supplied to the mixing device (1) at least corresponds to a minimum quantity of the load (A) in proportion to the quantity previously defined for mixture with the load (B).

According to one exemplary embodiment, the verification of the minimum quantity of the load (A) inside of the mixing device (1) is carried out by detection means (4) of a respective filling level.

According to one exemplary embodiment, the detection means (4) of filling level are mechanical, electro-mechanical or electronic, preferentially in the form of electronic temperature sensors.

According to one exemplary embodiment, the mixing temperature value ($T_M$) is previously defined between 40 and 100° C., preferentially between 50 and 90° C., more preferentially between 60 and 80° C.

According to one exemplary embodiment, the reference temperature level ($N_T$) corresponds to a variation range of 8%, preferentially of 5%, above and below the mixing temperature value ($T_M$).

According to one exemplary embodiment, the supply of additional thermal energy supply (Q2) is carried out during a previously defined reference period of time ($t_M$).

According to one exemplary embodiment, the supply of additional thermal energy (Q2) is carried out in intervals separated in time that begin when the temperature (T) descends to a previously defined minimum temperature ($T_{min}$) and end when the temperature (T) ascends to the mixing temperature value ($T_M$) or to another value with the reference temperature level ($N_T$).

According to one exemplary embodiment, the value of the minimum temperature ($T_{min}$) is of at least 60%, preferentially at least 70%, more preferentially at least 80% of the mixing temperature value ($T_M$).

According to one exemplary embodiment, the supply of mechanical energy (W1) takes place at least partially during the supply of the initial thermal energy (Q1).

According to one exemplary embodiment, the supply of mechanical energy (W1) starts after concluded the supply of the initial thermal energy (Q1).

According to one exemplary embodiment, the supply of mechanical energy (W1) is carried out by means of a rotation device (5) disposed so that it may rotate around an axis, preferentially the symmetry axis, at least substantially inside of the mixing device (1).

According to one exemplary embodiment, the supply of mechanical energy (W1) is carried out so that the rotation device (5) does a plurality of successive rotation cycles, preferentially in alternated rotation directions.

According to one exemplary embodiment, during the mixing period ($t_M$) the rotation cycles are initiated when the heating means (6) are turned off.

According to one exemplary embodiment, during the mixing period ($t_M$) the heating means (6) are turned off, or at least substantially reduce the thermal energy being provided, when a previously defined temperature value within the reference temperature level ($N_T$) is reached.

According to one exemplary embodiment, the supply of thermal energy (Q1, Q2) to the mixing device (1) by own heating means (6) and/or by autonomous one, preferentially driven by electric energy.

According to one exemplary embodiment, the discharge of the fusion (C) is carried out by means of opening a respective exit (7) at least during a previously defined period of time, and driven at least substantially by means of the gravity force.

According to one exemplary embodiment, the control of the process by the user is carried out by means of two actuation elements, preferentially in the form of buttons, preferentially by means of only one actuation element, besides of the on-off actuation element of the mixing device (1).

According to one exemplary embodiment, the state of execution of the process is communicated to the user by means of a light signal with at least one color, preferentially with at least one actuation frequency and preferentially at least one sound signal.

According to one exemplary embodiment, a mixing device (1) for carrying out the mixing process as described herein includes means for the substantially airtight closure of the load (A) of used cooking oils and the load (B) to the outside environment, at least during the mixing process, preferentially at least during the supply of additional thermal energy (Q2).

According to one exemplary embodiment, the mixing device (1) further includes an admission (2) for the load (A) of used cooking oils, an admission (3) for the load (B) of solidifying composition, both preferentially disposed in a respective top zone, thermal energy supply means (6), preferentially disposed in the vicinity of its exterior, more preferentially directly adjacent to its base zone, mechanical energy supply means (5) disposed in its interior, and an exit (7) for discharging the fusion (C) preferentially disposed in a lower part of its base zone.

According to one exemplary embodiment, the mixing device has a cross section of at least substantially circular format.

According to one exemplary embodiment, the mixing device has an interior diameter (d) that is at least the same as its interior height (h), preferentially substantially bigger than its interior height (h).

According to one exemplary embodiment, the mixing device has a base zone (8) that is configured at least slightly rounded, preferentially as a half spherical cap, and preferentially executed in material presenting a high thermal conductivity coefficient.

According to one exemplary embodiment, a thermal energy supply means (6) is disposed at least underneath the zone base (8) and is covered on the side that is opposed to the mixing device (1) by a material of reduced thermal conductivity coefficient.

According to one exemplary embodiment, the thermal energy supply means (6) is executed as electric resistance, preferentially in the form of at least one ring, disposed concentrically at least on the side of the base zone.

According to one exemplary embodiment, the mechanical energy supply means (5) is disposed in its interior, preferentially so that they may rotate around a central symmetry axis.

According to one exemplary embodiment, a mixing device (1) has mechanical energy means (5) that is executed at least approximately in the form of a rotating helix, with at least two blades (5'), preferentially with three, having a leading edge tilted by between 30° and 80° relatively to the rotation axis face.

According to one exemplary embodiment, the blades (5') extend over the most part of the interior diameter (d) and over the most part at least of the inferior half of the interior height (h).

According to one exemplary embodiment, the inferior edges of the blades are rounded and/or their inferior edge presents a notching.

According to one exemplary embodiment, the filling level detection means (4) is executed in the form of electronic temperature sensors, presenting as many previously defined reference filling levels (N1, N2, . . . ) as processing units (2) selected for simultaneous processing.

What is claimed is:

1. A mixing process of a load A including used cooking oils, or other fats, with a load B of a solidifying composition includes the steps of:

supplying an amount of the load (A) and an at least approximately corresponding amount of the load B to a mixing device so as to obtain a respective mixture;

supplying an initial thermal energy (Q1) amount to the mixing device (1) until the mixing temperature (T) reaches a temperature level ($N_T$) of a previously defined reference temperature value ($T_M$);

supplying an additional thermal energy (Q2) amount to the mixing device (1) during a previously defined period of time ($t_M$), at least so as for the mixing temperature (T) not to descend below a previously defined minimum temperature value ($T_{min}$); and discharging of a fusion (C) out of the mixing device (1), after the previously defined period of time ($t_M$), the fusion (C) being a substantially homogenous substance resulting from the mixture of loads A and B;

wherein the load B is in the form of a pre-processed pod comprising the solidifying composition and configured to be added to the mixing device as a discrete load, and the solidifying composition includes at least two substances, one of which is of a wax type and the other is one of stearic acid, aromatic, coloring substances and additives;

wherein the load B is supplied to the mixing device (1) after at least a substantial part of the load A has reached a previously defined initial temperature value ($T_{ini}$).

2. The process of claim 1, further including the step of supplying mechanical energy (W1) to the mixing device (1) during at least part of the period of time ($t_M$).

3. The process of claim 1, wherein the supply of the load A of used cooking oils to the mixing device (1) is preceded by a step of mechanic and/ or chemical filtering of the load A of used cooking oils.

4. The process of claim 1, wherein the step of supplying the load A of used cooking oils to the mixing device takes place through a temporary opening of an admission for the load A of used cooking oils during a previously defined period of time ($t_{adm}$) and until a minimum filling level is detected, and whose duration is at least function of the quantity of the load B of solidifying composition.

5. The process of claim 1, further including the step of automatically determining a quantity of the load A based upon an indication of a quantity of the load B to be processed in a respective mixing cycle.

6. The process of claim 1, wherein the load B is supplied in the form of at least one unit (B1), corresponding to a given quantity.

7. The process of claim 6, wherein, the quantity of the load A to be supplied to the mixing device (1) is at least approximately in the proportion of the mixture of between 95 ml and 105 ml of used cooking oils, for each unit (B1, . . . ) supplied, as load B of solidifying composition, in a respective mixing cycle.

8. The process of claim 1, wherein a beginning of supply of the initial thermal energy (Q1) takes place after verification of whether the quantity of the load A supplied to the mixing device (1) at least corresponds to a minimum quantity of the load A in proportion to a quantity previously defined for mixture with the load B.

9. The process of claim 8, wherein the verification of the minimum quantity of the load A inside of the mixing device (1) is carried out by detection means (4) of a respective filling level.

10. The process of claim 1, wherein the mixing temperature value ($T_M$) is between 60 and 80° C.

11. The process of claim 1, wherein the reference temperature level ($N_T$) corresponds to a variation range of 8% above and below the mixing temperature value ($T_M$).

12. The process of claim 1, wherein the supply of additional thermal energy (Q2) is carried out continuously such that the temperature (T) does not surpass the reference temperature level ($N_T$) during the period of time ($t_M$).

13. The process of claim 1, wherein a supply of mechanical energy (W1) is carried out by means of a rotation device disposed so that it rotates around an axis at least substantially inside of the mixing device.

14. The process of claim 13, wherein during the previously defined period of time ($t_M$) rotation of cycles of the rotation device are initiated when a heating means is turned off.

15. The process of claim 1, wherein the discharge of the fusion (C) is carried out by means of opening a respective exit at least during a previously defined period of time, and driven at least substantially by means of gravity force.

16. The process of claim 1, wherein the reference temperature level ($N_T$) corresponds to a variation range of 5% above and below the mixing temperature value ($T_M$).

* * * * *